US006096441A

United States Patent [19]

Hauser et al.

[11] Patent Number: 6,096,441

[45] Date of Patent: Aug. 1, 2000

[54] AUSTENOFERRITIC STAINLESS STEEL HAVING A VERY LOW NICKEL CONTENT AND A HIGH TENSILE ELONGATION

[75] Inventors: Jean-Michel Hauser; Herve Sassoulas, both of Ugine, France

[73] Assignee: USINOR, Puteaux, France

[21] Appl. No.: 09/107,422

[22] Filed: Jun. 30, 1998

[30] Foreign Application Priority Data

Jun. 30, 1997 [FR] France ..... 97 08180

[51] Int. Cl.[7] ..... B32B 15/10; C25D 5/10; C22C 38/18; C22C 38/20; C22C 38/24

[52] U.S. Cl. ..... 428/668; 428/681; 428/682; 428/683; 428/685; 420/34; 420/41; 420/60; 420/61; 420/62; 420/63; 420/71; 148/325; 148/506; 29/33 B; 75/10.62

[58] Field of Search ..... 148/325, 506; 420/34, 41, 60, 62, 61, 63, 71; 428/668, 681, 682, 683, 685; 29/33 B; 75/10.62

[56] References Cited

U.S. PATENT DOCUMENTS

| | | | |
|---|---|---|---|
| 2,624,670 | 1/1953 | Binder et al. | 75/125 |
| 3,784,418 | 1/1974 | Randak et al. | 148/506 |
| 3,926,685 | 12/1975 | Gueussier et al. | 148/506 |
| 4,047,941 | 9/1977 | Wright | 420/34 |
| 4,054,448 | 10/1977 | Wright | 420/56 |
| 4,218,268 | 8/1980 | Hiraishi et al. | 148/542 |
| 4,331,474 | 5/1982 | Espy | 75/124 |
| 4,828,630 | 5/1989 | Daniels et al. | 148/325 |
| 5,601,664 | 2/1997 | Kosa et al. | 148/325 |

FOREIGN PATENT DOCUMENTS

| | | |
|---|---|---|
| 327053 | 8/1989 | European Pat. Off. . |
| 2071873 | 9/1971 | France . |
| 2119612 | 8/1972 | France . |
| 61035 | 8/1970 | Luxembourg . |

OTHER PUBLICATIONS

Patent Abstracts of Japan, vol. 14, No. 318 (C–738), Jul. 9, 1990 & JP 02 111846 A (Kawasaki Steel Corp.), Apr. 24, 1990.

*Primary Examiner*—Paul Thibodeau
*Assistant Examiner*—Holly C. Rickman
*Attorney, Agent, or Firm*—Oblon, Spivak, McClelland, Maier & Neustadt, P.C.

[57] ABSTRACT

An austenoferritic stainless steel with high tensile elongation includes iron and the following elements in the indicated weight amounts based on total weight:

carbon<0.04%

0.4%<silicon<1.2%

2%<manganese<4%

0.1%<nickel<1%

18%<chromium<22%

0.05%<copper<4% sulfur<0.03% phosphorus<0.1%

0.1%<nitrogen<0.3% molybdenum<3% the steel having a two-phase structure of austenite and ferrite and comprising between 30% and 70% of austenite, wherein Creq=Cr %+Mo %+1.5 Si %

Nieq=Ni %+0.33 Cu %+0.5 Mn %+30 C %+30 N % and Creq/Nieq is from 2.3 to 2.75, and wherein

IM=551–805(C+N)%—8.52 Si %—8.57 Mn %—12.51 Cr %—36 Ni %—34.5 Cu %—14 Mo %,

IM being from 40 to 115.

19 Claims, 1 Drawing Sheet

AUSTENOFERRITIC STAINLESS STEEL HAVING A VERY LOW NICKEL CONTENT AND A HIGH TENSILE ELONGATION

TECHNICAL FIELD

The present invention relates to austenoferritic stainless steels.

BACKGROUND OF THE INVENTION

Stainless steels are classified into large families depending on their metallurgical structures, after a heat treatment. Martensitic ferritic, austenitic and austenoferritic stainless steels are known.

The latter family comprises steels which are generally rich in chromium and nickel, that is to say that they have respective chromium and nickel contents greater than 20% and greater than 4%. The structure of these steels, after treatment at a temperature of between 950° C. and 1150° C., consists of ferrite and of austenite in a proportion generally greater than 30% for both phases.

These steels have many practical advantages, in particular they have, in the annealed state, for example after being annealed at 1050° C., mechanical properties, especially yield stress, which is much higher than ferritic or austenitic stainless steels in the annealed state. On the other hand, the ductility of these steels is of the same order of magnitude as that of ferritic steels and lower than that of austenitic steels.

One of the advantages of austenoferritic steels relates to weld properties. After a welding operation, the structure of these stainless steels, in the melt zone and in the heat-affected zone, remains highly polyphase in terms of ferrite and austenite, contrary to austenitic steels in which the weld remains mainly austenitic. This results in high mechanical properties of the welds, properties which are desirable when welded assemblies must withstand mechanical stresses in operation.

Finally, certain austenoferritic steels containing finely divided austenite may have a high plasticity called superplasticity during hot slow forming.

These austenoferritic steels also have drawbacks such as, for example, their high cost, because their composition has a high nickel content or because of manufacturing difficulties, especially those related to their high chromium content, such as, for example, the formation of an embrittling sigma phase or separation into an iron-rich ferrite and a chromium-rich ferrite with embrittlement of the steels during cooling after hot rolling.

Their ductility, measured by the tensile elongation at ambient temperature does not exceed 35%, which renders its processing, by drawing, forging or any other process, difficult.

Embrittlement also occurs during use of the steel at a temperature above 300° C. when the temperature hold exceeds a few hours.

OBJECTS OF THE INVENTION

One object of the invention is to provide an austenoferritic steel containing in its composition a very low nickel content and having the advantageous properties of the austenoferritic family which are associated with improved general properties.

DESCRIPTION OF THE INVENTION

Figure 1:
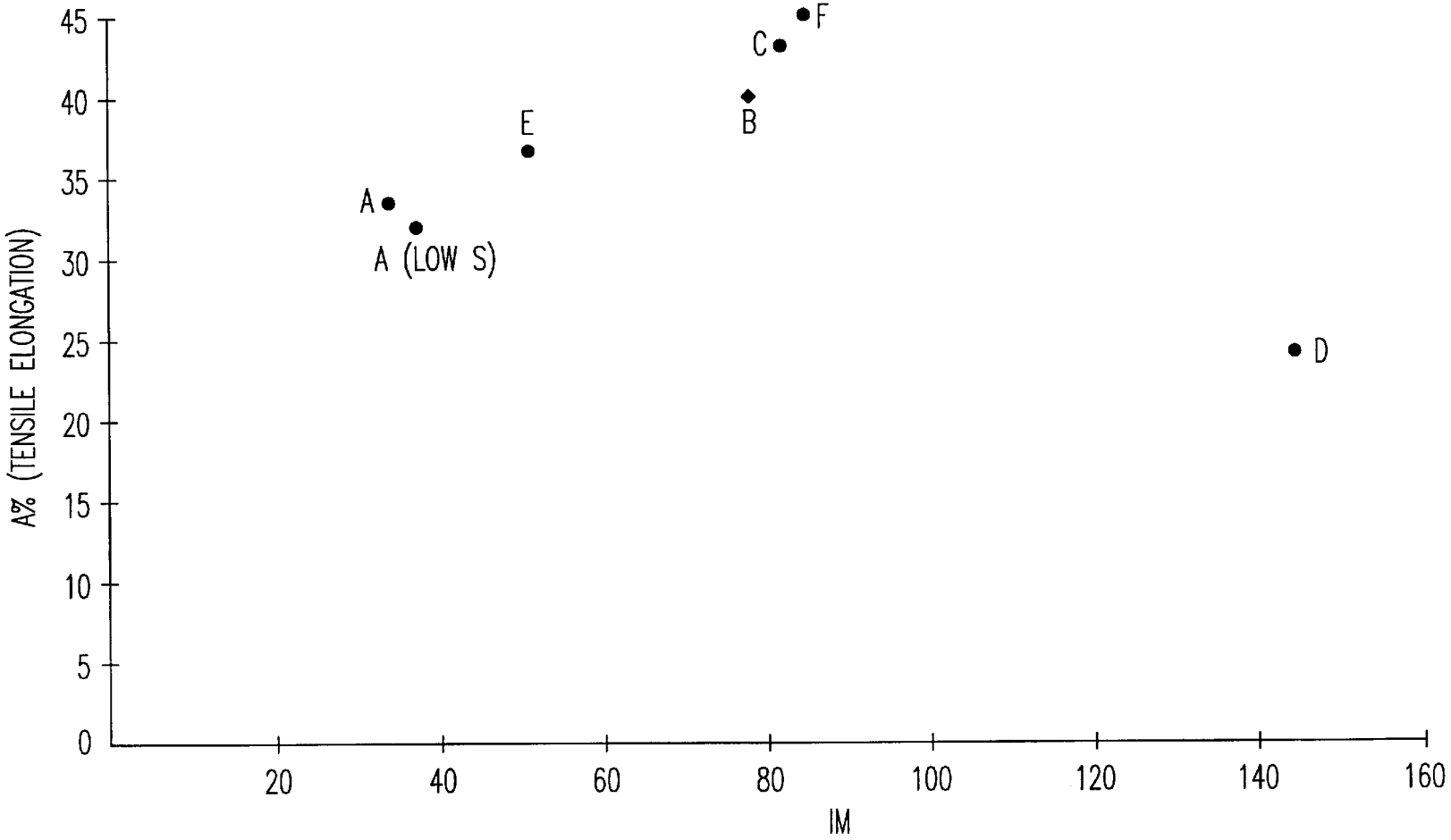
FIG. 1 depicts a curve showing the dependence of elongation property on IM index.

The invention austenoferritic stainless steel preferably having a very low nickel content and a high tensile elongation, comprises the following elements preferably in amounts indicated by weight based on total weight:

carbon<0.04%

0.4%<silicon<1.2%

2%<manganese<4%

0.1%<nickel<1%

18%<chromium<22%

0.05%<copper<4% sulfur<0.03% phosphorus<0.1%

0.1%<nitrogen<0.3% molybdenum<3% as well as iron and impurities from smelting, the steel most preferably having a two-phase structure of from 30% to 70% (including 40, 50 and 60%) of austenite with the substantial remainder or complete remainder ferrite, and where Creq=Cr %+Mo %+1.5 Si %

Nieq=Ni %+0.33 Cu %+0.5 Mn %+30 C %+30 N % with Creq/Nieq between 2.3 and 2.75, the stability of the austenite of said steel being controlled by the IM index defined, based on the weight composition of the steel, by IM=551–805(C+N)%—8.52 Si %—8.57 Mn %—12.51 Cr %—36 Ni %—34.5 Cu %—14 Mo %, IM being between 40 and 115 (including 50, 60, 70, 80, 90, 100 and 110).

Other characteristics of the invention include:

the composition satisfies the relationship: Creq/Nieq of between 2.4 and 2.65.

the sulfur content is less than or equal to 0.0015%;

the steel further comprises, in its composition by weight, from 0.010% to 0.030% of aluminum;

the steel further comprises, in its composition by weight, from 0.0005% to 0.0020% of calcium;

the steel further comprises, in its composition by weight, from 0.0005% to 0.0030% of boron;

the carbon content is less than or equal to 0.03%;

the nitrogen content is between 0.12% and 0.2%;

the chromium content is between 19% and 21%;

the silicon content is between 0.5% and 1%;

the copper content is less than 3%;

the phosphorus content is less than or equal to 0.04%.

The description which follows, completed by the single appended figure, both being given by way of non-limiting example, will make the invention clearly understood.

The invention austenoferritic steel preferably contains low contents of alloying elements, especially a nickel content of less than 1% and a chromium content of less than 22%. The low nickel content is imposed for economic and ecological reasons, the reduction in the chromium content making it possible, on the one hand, to smelt the steel easily and, on the other hand, to avoid hot embrittlement both during manufacture of said steel and during its use.

The invention results from an observation that a specific composition range makes it possible, in the family of the steel in question, to obtain a particular tensile-elongation improvement associated with a high yield stress.

The invention steel may be produced in the form of molded or forged products, hot- or cold-rolled sheet, bar, tube or wire, etc. Various castings were produced, the compositions of which are given in Table 1 below.

| | Composition by weight of the steel: | | | | | | | | | |
|---|---|---|---|---|---|---|---|---|---|---|
| | D | C | B | A | A (low S) | E | F | C (low S) | G | C (low S, B) |
| C | 0.028 | 0.025 | 0.031 | 0.033 | 0.03 | 0.03 | 0.032 | 0.033 | 0.036 | 0.033 |
| Si | 0.538 | 0.525 | 0.485 | 1.055 | 1.06 | 1.10 | 0.575 | 0.494 | 0.947 | 0.538 |
| Mn | 3.718 | 3.747 | 3.786 | 4.073 | 3.89 | 3.99 | 3.847 | 3.825 | 5.018 | 3.758 |
| NI | 0.087 | 0.809 | 0.811 | 0.817 | 0.824 | 0.821 | 0.527 | 0.839 | 0.832 | 0.840 |
| Cr | 18.9 | 19.89 | 20.71 | 21.2 | 21.19 | 20.2 | 19.01 | 19.86 | 18.96 | 19.86 |
| Mo | 0.035 | 0.036 | 0.036 | 0.037 | 0.211 | 0.212 | 0.211 | 0.296 | 0.210 | 0.209 |
| Cu | 0.044 | 0.392 | 0.391 | 0.395 | 0.4 | 0.402 | 1.023 | 0.384 | 3.048 | 0.333 |
| O | | | | | 35–37 ppm | 17–19 ppm | 33–37 ppm | 37–38 ppm | 32–32 ppm | 26–28 ppm |
| S | 34 ppm | 35 ppm | 35 ppm | 37 ppm | 6 ppm | 4 ppm | 10 ppm | 12 ppm | 9 ppm | 10 ppm |
| B | | | | | | | | | | 14 ppm |
| P | 0.017 | 0.018 | 0.017 | 0.018 | 0.017 | 0.017 | 0.018 | 0.016 | 0.019 | 0.016 |
| Al | — | — | — | — | 0.010 | 0.010 | 0.007 | 0.007 | 0.011 | 0.007 |
| N | 0.132 | 0.15 | 0.136 | 0.17 | 0.167 | 0.166 | 0.155 | 0.143 | 0.104 | 0.136 |
| V | 0.091 | 0.094 | 0.097 | 0.103 | — | 0.072 | 0.078 | 0.081 | 0.088 | 0.086 |

Table 2 below gives the characteristics of the steels in terms of the IM index and of the equivalent chromium/equivalent nickel ratio.

| | D | C | B | A | A (low S) | E | F | C (low S) | G | C (low S, B) |
|---|---|---|---|---|---|---|---|---|---|---|
| IM | 144 | 81 | 78 | 35 | 38 | 51 | 68 | 78 | 12 | 85 |
| Creq/Nieq | 2.92 | 2.57 | 2.74 | 2.51 | 2.61 | 2.50 | 2.39 | 2.55 | 2.41 | 2.64 |

Within a short production range, the steel undergoes a forging operation from a temperature of 1200° C. followed by a hot conversion from 1240° C. in order to obtain, for example, a hot-rolled strip 2.2 mm in thickness. The strip is treated at 1050° C. and then quenched in water.

Within a so-called long range, after the short range, the hot-rolled strip can then be cold rolled and again treated at 1040° C. for one minute and then quenched in water.

All the steels presented are composed of ferrite and austenite, except steel D which furthermore contains martensite formed during cooling of the austenite. The structure of the steels is always free of carbides and nitrides. It is observed that three steels, B and C and F, have, on the one hand, an elongation at break of greater than or equal to 40% when they are produced with the long range and, on the other hand, yield stresses greater than 450 MPa and tensile strengths greater than 700 MPa. Furthermore, steel C has both a high yield stress and a particularly high elongation.

Using an austenite stability index such as: IM=551–805 (C+N)%—8.52 Si %—8.57 Mn %—12.51 Cr %—36.02 Ni %—34.52 Cu %—13.96 Mo %, it is observed, as shown in the FIG. 1, that the elongation at break of these austenoferritic steels passes through a maximum when the above defined IM index related to the composition of the steel according to the invention is between 40 and 115, which defines a steel according to the invention having an elongation of greater than 35%.

The characteristics of the sheet obtained according to the invention are combined in Table 3 which shows the contents of austenite for four steels in the various phases of conversion, as-hot-rolled, produced in the short range and produced in the long range.

TABLE 3

| | Austenite contents in % | | | |
|---|---|---|---|---|
| Steel | D | C | B | A |
| As-hot-rolled | 37 | 42 | 33 | 35 |
| Short range | 41 | 49 | 39 | 40 |
| Long range | 42 | 52 | 41 | 43 |

These austenite contents lie within the 30% to 70% ranges which are desired in austenoferritic steels. The steels have respectively a Creq/Nieq ratio as recommended according to the invention.

Table 4 below gives the mechanical properties for steels B and C according to the invention, these being subjected to the two preparation ranges, for steels E and F according to the invention, which are subjected to the long preparation range, the properties being compared with those of steels A and D outside the invention.

TABLE 4

| | Mechanical properties | | | | |
|---|---|---|---|---|---|
| Steel | Yield stress Rp 0.2% (MPa) | Yield stress Rm (MPa) | Elongation A% | IM | Post-tension martensite % |
| D | | | | 144 | |
| Short range | 406 | 804 | 32 | — | — |
| Long range | 433 | 855 | 24 | — | 31 |
| C | | | | 81 | |
| Short range | 476 | 757 | 46 | — | — |
| Long range | 501 | 817 | 43 | — | 27 |

TABLE 4-continued

| Mechanical properties | | | | | |
|---|---|---|---|---|---|
| Steel | Yield stress Rp 0.2% (MPa) | Yield stress Rm (MPa) | Elongation A% | IM | Post-tension martensite % |
| B | | | | 78 | |
| Short range | 450 | 668 | 34 | — | — |
| Long range | 471 | 714 | 40 | — | 5 |
| E | | | | 51 | |
| Short range | — | — | — | — | — |
| Long range | 484 | 737 | 36 | — | — |
| F | | | | 68 | |
| Short range | — | — | — | — | — |
| Long range | 492 | 819 | 44 | — | — |
| A | | | | 35 | |
| Short range | 496 | 718 | 36 | — | — |
| Long range | 520 | 773 | 33 | — | 0 |

It may be observed that steels B, C and F, the IM index of which is respectively 78, 81 and 68, i.e. lying between 40 and 115, have a particularly high elongation compared to steels A and D outside the invention.

Table 5 below gives the degree of formation of strain-hardening martensite due to the effect of the tension on steels subjected to overhardening at 1040° C.

| STEEL | A | B | C | D |
|---|---|---|---|---|
| % of austenite | 43 | 41 | 52 | 42 |
| Distributed elongation | 25 | 33 | 37 | 22 |
| % of post-tension austenite | 43 | 36 | 25 | 9 |
| Appearance of martensite (%) | 0 | 5 | 27 | 31 |
| Fraction of austenite transformed to martensite during tension. | 0 | 0.12 | 0.52 | 0.74 |

In the case of steels B and C respectively, 12% and 52% of the initial austenite are transformed to martensite during the tension, which gives them good ductility; in contrast, in steel A the austenite is not transformed to martensite during tensioning and steel D has too high a degree of austenite transformation, namely 74%, which gives it insufficient ductility.

Tables 6 and 7 show hot tensile properties of various steels.

The mechanical properties were measured on an annealed wrought steel. It was wrought by forging from 1200° C. The steel was then annealed at a temperature of 1100° C. for 30 mn. The tensile test pieces used are test pieces having a gauge part of circular cross section having a diameter of 8 mm and a length of 5 mm. They are preheated for 5 mm at 1200° C. or 1280° C. and then cooled at 2° C./s down to the test temperature at which the tensioning is carried out; tensioning carried out at a rate of 73 mn/s.

TABLE 6

| % diameter reduction in hot tensile tests with initial temperature hold at 1200° C. | | | | | | |
|---|---|---|---|---|---|---|
| TEST TEMPERATURE | STEEL C | E | F | C low S | G | C (low S; B) |
| 900° C. | 34 | 42 | 50 | 46 | 22 | 49 |
| 950° C. | 33 | 43 | 45 | 46 | 13 | 47 |
| 1000° C. | 36 | 44 | 42 | 49 | 24 | 53 |
| 1050° C. | 48 | — | 40 | 49 | 24 | 53 |

TABLE 6-continued

| % diameter reduction in hot tensile tests with initial temperature hold at 1200° C. | | | | | | |
|---|---|---|---|---|---|---|
| TEST TEMPERATURE | STEEL C | E | F | C low S | G | C (low S; B) |
| 1100° C. | 52 | — | 43 | 54 | 35 | 59 |
| 1150° C. | 65 | — | 51 | 58 | 42 | 62 |
| 1200° C. | 69 | — | 61 | 68 | 42 | 65 |

TABLE 7

| % diameter reduction in hot tensile tests with an initial temperature hold at 1280° C. | | | | | |
|---|---|---|---|---|---|
| TEST TEMPERATURE | STEEL A | E | F | C (low S) | C (low S; B) |
| 900° C. | 33 | 33 | | 37 | 39 |
| 950° C. | 34 | 31 | | 37 | 38 |
| 1000° C. | 35 | 35 | | 38 | 38 |
| 1050° C. | 42 | 38 | | 43 | 44 |
| 1100° C. | 47 | 43 | | 50 | 54 |
| 1150° C. | 50 | 48 | | 55 | 53 |
| 1200° C. | 62 | 54 | | 63 | 64 |
| 1250° C. | 67 | 67 | | 77 | 70 |
| 1280° C. | 81 | 77 | | 85 | 76 |

The hot ductility is generally low, but an improvement is observed in the case of steels containing less than $15\times10^{-4}$% of sulfur in their composition. A diametral reduction in section of greater than 45% at 1000° C. is regarded as necessary for hot rolling the steels. Steel C (low S) and steel C (low S; B) containing boron in its composition achieve this characteristic if the reheat is carried out at 1200° C.

The high hot ductility characteristics are obtained according to the invention in the presence of a very low sulfur content. Steel C, containing $35\times10^{-4}$% of sulfur does not have a sufficient hot ductility.

The carbon content should not exceed 0.04%, otherwise chromium carbides precipitate at the ferrite/austenite interfaces on cooling after heat treatment and impair the corrosion resistance. A carbon content of less than 0.03% makes it possible to avoid this precipitation at the lowest cooling rates.

The silicon content should be greater than 0.4% in order to avoid excessive oxidation while slabs or blooms are being reheated. It is limited to 1.2% in order to avoid favoring the embrittling precipitations of intermetallics or of sigma phase during hot conversion. Preferably, the silicon content is between 0.5% and 1%.

The manganese content should not exceed 4% in order to avoid production difficulties. However, a minimum content of 2% is necessary for making the steel austenitic, while allowing the introduction of more than 0.1% of nitrogen, without exceeding the nitrogen solubility limit during solidification.

The nickel content is intentionally limited to 1% for economic reasons and also in order to limit the stress corrosion in chloride media.

In addition, international directives are aimed at reducing the release of nickel from materials, especially in the water field and in the case of contact with the skin.

Molybdenum may be optionally added in order to improve the corrosion resistance; its effectiveness barely increases above 3% and, moreover, molybdenum tends to increase embrittlement by sigma-phase formation, and its addition must be limited.

Copper addition is particularly effective for increasing the austenite content. Above 4%, hot-rolling defects appear, these being due to copper-rich solidification segregation. Copper addition also hardens the ferrite phase by heat treatment between 400° C. and 600° C. and may have, in use, a bactericidal and fungicidal effect.

The sulfur content should be limited to 0.030% in order for the steel to be weldable without generating hot cracking. A sulfur content of less than 0.0015% significantly improves the hot ductility and the quality of the hot rolling. This low sulfur content may be obtained by the controlled use of calcium and aluminum in order to obtain the desired ranges of Ca, Al and S contents.

A boron content of 5 to $30\times10^{-4}$% also improves the hot ductility.

The phosphorus content is less than 0.1% and preferably less than 0.04% in order to avoid hot cracking during welding.

The nitrogen content is naturally limited to 0.3% by its solubility in the steel during its production.

For manganese contents of less than 3%, the nitrogen content should preferably be less than 0.2%. A minimum of 0.1% of nitrogen is necessary in order to obtain an amount of austenite greater than 30%.

The chromium content is sufficiently low to avoid embrittlement due to the sigma phase and to ferrite-ferrite separation, during hot conversion. The chromium contents according to the invention also allow superplastic forming at moderate temperatures between 700° C. and 1000° C. without forming the embrittling sigma phase, contrary to the usual austenoferritic grades used for thermoplastic forming.

An austenite content of 30 to 70% is necessary in order to obtain the high mechanical properties, i.e. a yield stress greater than 400 MPa on steel produced and on a weld, the weld having to be hard and tough, with an austenite content of greater than 20%. To achieve this, the Creq/Nieq ratio will be satisfied so that it is between 2.3 and 2.75 and preferably between 2.4 and 2.65. The tensile elongation greater than 35% is obtained if the IM index is between 40 and 115, and the steel according to the invention has good drawing characteristics under these conditions.

The steel according to the invention is particularly intended for the use of pieces which are drawn and then joined together by welding, such as tanks for propellants or for containing other pyrotechnic reactants which can be used, in particular, for automobile airbag devices, applications which require a steel having a high ductility, in order to shape it, as well as an equally high yield stress of the base metal and of the weld necessary in the use in question.

It is also intended in particular for the manufacture of tubes from rolled and then welded sheets, these being able to be used especially in the construction of mechanical structures fixed or incorporated into automobiles. These tubes may be shaped using high-pressure forming processes called hydroforming.

French patent application 97 08180 is incorporated herein by reference.

What is claimed is:

1. An austenoferritic stainless steel comprising iron and the following elements in the indicated weight amounts based on total weight:

carbon<0.04%

0.4%<silicon<1.2%

2%<manganese<4%

0.1%<nickel<1%

18%<chromium<22%

0.05%<copper<4% sulfur<0.03% phosphorus<0.1%

0.1%<nitrogen<0.3% molybdenum<3% the steel having a two-phase structure of austenite and ferrite and comprising between 30% and 70% of austenite, wherein Creq=Cr %+Mo %+1.5 Si %

Nieq=Ni %+0.33 Cu %+0.5 Mn %+30 C %+30 N % and Creq/Nieq is from 2.3 to 2.75, and wherein

IM=551–805(C+N)%—8.52 Si %—8.57 Mn %—12.51 Cr %—36 Ni %—34.5 Cu %—14 Mo %,

IM being from 40 to 115.

2. The steel as claimed in claim 1, wherein the composition satisfies the relationship: Creq/Nieq is from 2.4 to 2.65.

3. The steel as claimed in claim 1 wherein the sulfur content of said steel is less than or equal to 0.0015%.

4. The steel as claimed in claim 1 wherein the steel further comprises, in its composition by weight, from 0.010% to 0.030% of aluminum.

5. The steel as claimed in claim 1 wherein the steel further comprises, in its composition by weight, from 0.0005% to 0.0020% of calcium.

6. The steel as claimed in claim 1 wherein the steel further comprises, in its composition by weight, from 0.0005% to 0.0030% of boron.

7. The steel as claimed in claim 1 wherein the carbon content is less than or equal to 0.03%.

8. The steel as claimed in claim 1 wherein the nitrogen content is between 0.12% and 0.2%.

9. The steel as claimed in claim 1 wherein the chromium content is between 19% and 21%.

10. The steel as claimed in claim 1 wherein the silicon content is between 0.5% and 1%.

11. The steel as claimed in claim 1 wherein the copper content is less than 3%.

12. The steel as claimed in claim 1 wherein the phosphorus content is less than or equal to 0.04%.

13. A container comprising the steel of claim 1.

14. The container of claim 13, wherein said container comprises pieces of said steel welded together.

15. A process of making a steel, the process comprising smelting an iron-containing ore and forming the austenoferritic stianless steel of claim 1.

16. A process of using a steel, the process comprising forming the austenoferritic stainless steel of claim 1.

17. A process as claimed in claim 16, wherein the forming comprises drawing.

18. The process as claimed in claim 16, wherein the forming comprises hydroforming.

19. A process of using a steel, the process comprising welding the austenoferritic stainless steel of claim 1.

* * * * *